United States Patent [19]

Lemke et al.

[11] Patent Number: 4,984,786

[45] Date of Patent: Jan. 15, 1991

[54] WEIGHT SUSPENSION APPARATUS FOR SQUAT EXERCISES

[76] Inventors: William E. Lemke, 2022 E. Marion St., Shorewood, Wis. 53211; Gregory G. Reshell, 1121 E. Hamilton St., Milwaukee, Wis. 53202

[21] Appl. No.: 436,371

[22] Filed: Nov. 14, 1989

[51] Int. Cl.[5] ..... A63B 21/65

[52] U.S. Cl. ..... 272/119; 272/117; 272/143

[58] Field of Search ..... 272/93, 117, 119, 123, 272/143, DIG. 4; 2/309, 311, 312

[56] References Cited

U.S. PATENT DOCUMENTS

| | | | |
|---|---|---|---|
| 3,458,188 | 7/1969 | Infante | 2/312 X |
| 3,751,031 | 8/1973 | Yamauchi | 272/119 |
| 4,589,658 | 5/1986 | Gibson | 272/119 |
| 4,911,434 | 3/1990 | Herring | 272/119 |

FOREIGN PATENT DOCUMENTS

| | | | |
|---|---|---|---|
| 1015790 | 8/1977 | Canada | 272/119 |

OTHER PUBLICATIONS

Auch Leder Macht Muskel, German Publication, Dec. 1983, p. 138.

*Iron Man,* May 1985, vol. 44, No. 4, p. 79.

*Primary Examiner*—Robert Bahr

*Attorney, Agent, or Firm*—Andrus, Sceales, Starke & Sawall

[57] ABSTRACT

A weight suspension apparatus for squat exercises. The apparatus comprises a belt, a front strap, a rear strap, a weight and a multi-link chain for connecting the weight to the front and rear straps. The front and rear straps are each preferably V-shaped, with the nadir of the V-shape depending between the legs of the user. The upper ends of the front and rear straps are preferably connected to the belt so that an upper end of each is located on either side of the user's body when the belt is secured thereto. The weight is attached to the straps by a multi-link chain allowing variable placement of the weight in a front-rear direction, to change the point of attachment of the weight according to location of the user's center of gravity.

10 Claims, 4 Drawing Sheets

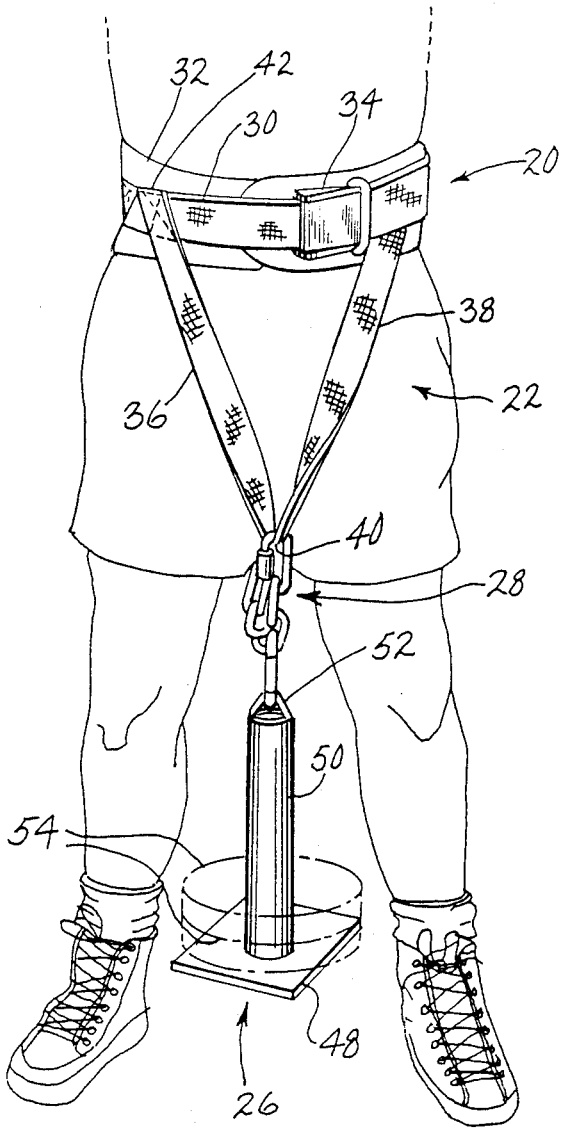
FIG. 1
FIG. 2
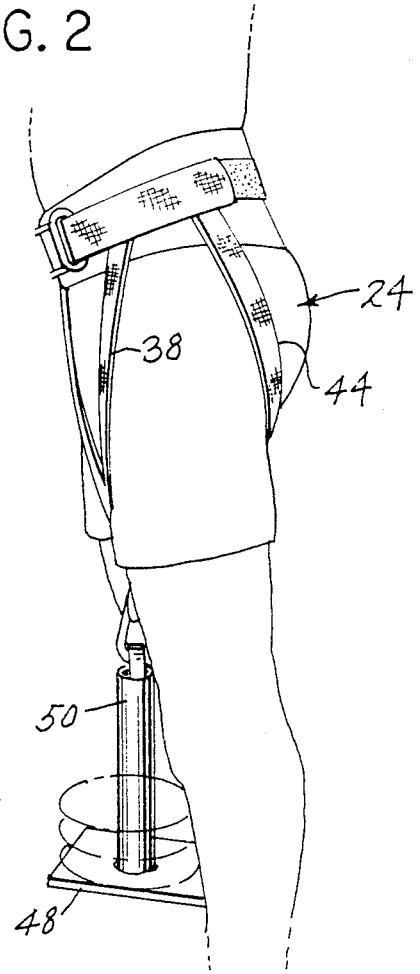
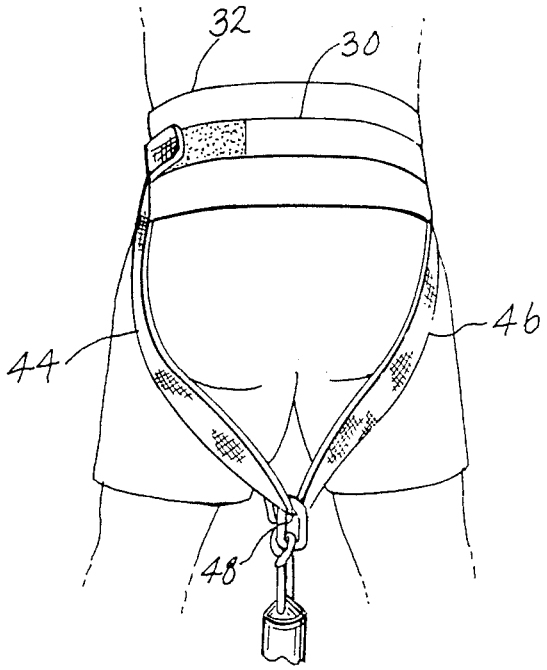
FIG. 3

WEIGHT SUSPENSION APPARATUS FOR SQUAT EXERCISES

BACKGROUND AND SUMMARY

This invention relates to exercise apparatus, and more particularly to an apparatus for performing squat exercises.

In exercise and rehabilitation applications, it is often the case that a person wishes to exercise a certain set of muscles. For a healthy person, this exercise may be one of a series of exercises performed in order to provide overall conditioning to the body. For an injured person, muscle group-specific exercising allows the person to concentrate on rehabilitation of, or reconditioning of, the desired muscle group.

Squat exercises can be an important part of a conditioning or rehabilitation program to strengthen lower extremity musculature. In the past, squat exercises have been performed by a person balancing a weight on his or her shoulders behind the neck, and thereafter squatting while supporting the weight in this manner. This presents numerous drawbacks, most notably if the person has injured his or her back, or does not have sufficient back strength to support enough weight necessary to properly exercise the muscles stressed by squat exercises. Additionally, because squat exercises demand that the exerciser constantly maintain his or her balance during the entire range of motion of the exercise, it is difficult to provide an injury-free range of motion to the exerciser during performance of a squat exercise.

It is an object of the present invention to provide a resistance training device which allows a person to properly perform squat exercises without significant compressive or shear stress to the spine.

In accordance with the invention, a weight suspension apparatus for squat exercises comprises a belt, securing means for firmly securing the belt about the waist of a user, front and rear V-shaped straps connected at their upper ends to the belt, and a system for suspending a weight between the user's legs between the lowermost points of the front and rear straps. The nadir of each of the V-shaped front and rear straps is disposed between the user's legs. In a preferred embodiment, the weight is secured to the front and rear straps by means of a weight connection member spanning between the front and rear straps and connected at the nadir of each. Means is provided for attaching the weight to be lifted to the weight connection member, as is means for accommodating movement of the attaching means to various locations along the length of the weight connection member. The weight connection member may comprise a multi-link chain extending between the front and rear V-shaped straps. The attaching means accomodates attachment of the weight to any one of the links in the chain between the front and rear V-shaped straps, so as to allow varying location of the point of attachment of the weight to the weight connection member. Alternatively, the weight connection member may comprise a strap extending between the front and rear straps at the nadir of each. In this embodiment, the attaching means comprises a connector member moveable along the length of the flexible strap. In this manner, automatic movement of the attaching means along the weight connection member is provided, according to user requirements.

The front and rear straps are preferably connected to the belt so that the upper ends of each are disposed one on either side of the user's body. Preferably, an upper end of the front strap is disposed closely adjacent an upper end of the rear strap on either side of the user's body. On each side of the user's body, the upper ends of the front and rear straps are located closely anteriorly and posteriorly, respectively, of the user's greater trochanter. Preferably, with this arrangement, the legs of the front strap run along the user's inguinal ligaments to a point between the user's legs at approximately the point of intersection of the inguinial ligaments extended. The rear V-shaped strap provides a pair of legs, each of which runs along the lateral aspect of the user's gluteal mass, and at least partially along the user's gluteal fold to a point between the user's legs. With the described arrangement, the user can concentrate on exercising the desired set of muscles without undue concern about maintaining balance and undue stress on the user's back and upper body.

BRIEF DESCRIPTION OF THE DRAWINGS

The drawings illustrate the best mode presently contemplated of carrying out the invention.

In the drawings:

FIG. 1 is a partial perspective view showing the weight suspension apparatus of the invention in place on a user;

FIG. 2 is a side view of the weight suspension apparatus of FIG. 1;

FIG. 3 is a rear elevation view of the weight suspension apparatus of FIGS. 1 and 2;

DETAILED DESCRIPTION OF THE PREFERRED EMBODIMENT

Figure 4:
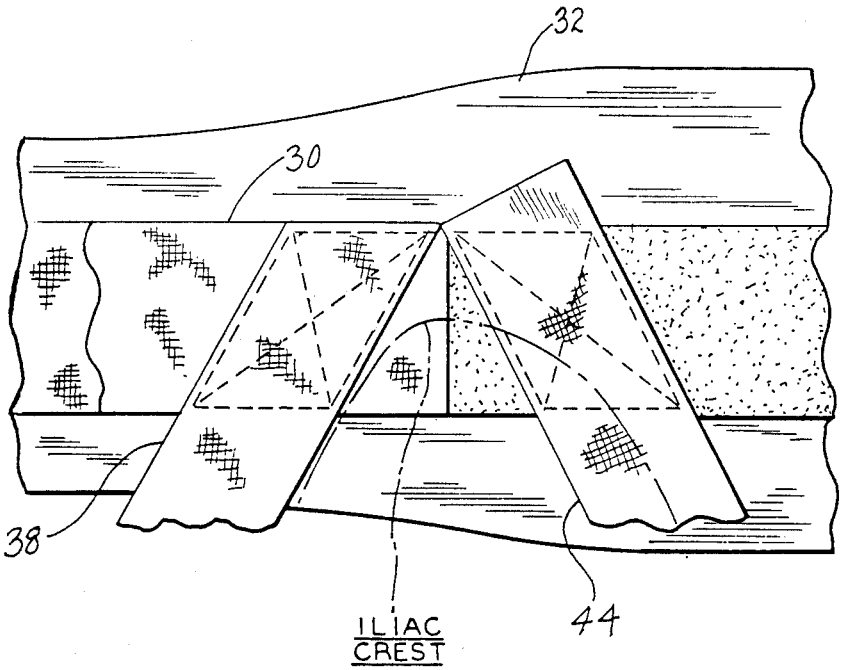
FIG. 4 is an enlarged partial side elevation view showing the connection of an upper end of the front V-shaped strap and of the rear V-shaped strap.

Referring to FIGS. 1, 2 and 3, an exerciser is shown wearing a weight suspending apparatus constructed of according to the invention, which generally includes a belt 20, a front V-shaped strap 22, and rear V-shaped strap 24, a weight stand 26 for supporting a predetermined amount of weight, and a weight connection system shown at 28.

Belt 20 may be any satisfactory weight lifting belt which is adapted to withstand a high degree of stress. Particularly, it has been found that a belt as manufactured by the Valeo Company of Milwaukee, Wis. under its U.S. Pat. No. 4,782,535 is satisfactory. By this reference, the disclosure of the noted patent is hereby incorporated. Broadly, belt 20 includes a web 30, to which is sewn padding 32. A buckle 34 is provided for securing belt 20 about the user's waist.

In accordance with the invention, front strap 22 is substantially V-shaped, and is stitched at its upper ends to web 30 of belt 20. Preferably, strap 22 is constructed of the same or similar nylon mesh as is web 30, so as to withstand a large amount of load placed thereon.

As shown, front strap 22 includes a first leg 36 and a second leg 38, which depend from web 30 and provide a nadir 40 which is located between the user's legs. The upper ends of front strap 22, one of which is shown at 42, are located on web 30 such that one is located on either side of the user's body when belt 20 is secured thereto. Preferably, front strap legs 36, 38 run over the user's anterior superior iliac spines, and descend downwardly along the user's inguinal ligaments to a point somewhat below the user's pubic symphysis. The attachment of the upper end of front strap legs 36, 38 is preferably located above and anteriorly of the user's greater trochanters.

Rear strap 24 includes legs 44, 46, each connected at its upper end to web 30, and providing a nadir 48 located between the user's legs. As with front strap 22, the upper ends of rear strap legs 44, 46 are preferably stitched to web 30. The upper ends of rear strap legs 44, 46 are located above and posteriorly of the user's greater trochanters.

Weight 26 preferably comprises a weight supporting stand including a base 48 and an upstanding post 50. An inverted V-shaped attachment member 52 is connected at the upper end of post 50. A plurality of weights, such as shown in phantom at 54, are adapted for placement onto post 50 to be supported by base 48, to provide a predetermined weight as desired by the user for exercising.

Weight connecting system 28 is described in greater detail with reference to FIGS. 5 and 6. As shown, a series of links **56*a*–56*e* comprise a multi-link chain, the end links of which are connected to front and rear straps 22, 24 respectively at their nadirs 40, 48, respectively. An S-hook 58, which is connected at the upper end of a multi-link chain having its lower end connected to inverted V-shaped member 52 provided at the upper end of post 50, is engaged with link 56*c* so as to secure weight 26 thereto. As shown if FIG. 5, weight 26 is thus located midway between the nadirs of front and rear straps 22, 24**.

Figure 5:
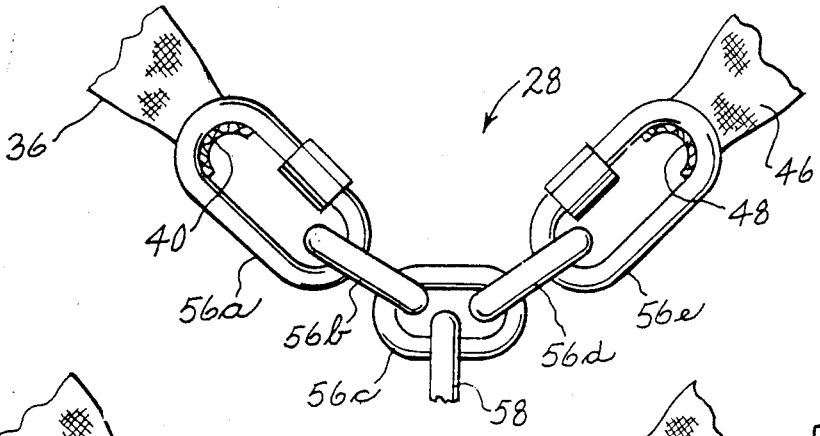
FIG. 5 is a partial side elevation view showing the multi-link chain system for connecting the weight to the front and rear straps.
Figure 6:
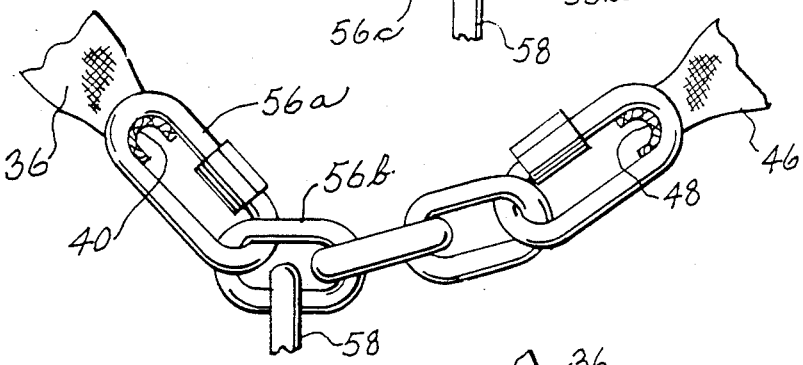
FIG. 6 is a view similar to FIG. 5 showing movement of the point of attachment of the weight to the multi-link chain.

When desired, S-hook 58 may be moved to its FIG. 6 position slightly forwardly of the position as shown in FIG. 5. In this manner, it is possible for the user to vary the position of the point of attachment of weight 26 to the multi-link chain. Such variation in positioning of the point of attachment of weight 26 accommodates varying centers of gravity between different users. This feature is important, in that it allows the user to properly perform squat exercises by minimizing undesired forces on the exerciser's musculoskeletal system, especially the spine.

Figure 7:
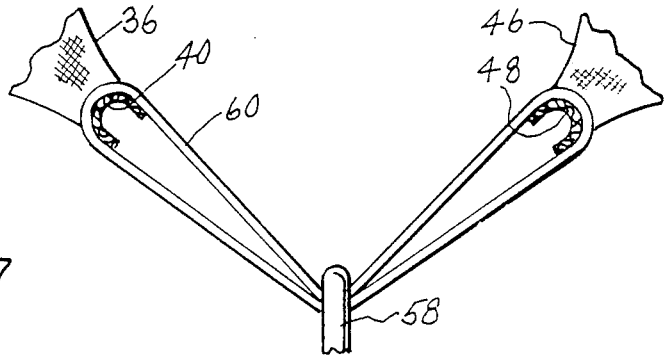
FIG. 7 is a view similar to FIGS. 5 and 6, showing a continuously variable position system for varying the point of attachment of the weight to the connection member between the front and rear straps.

An alternate arrangement for attaching weight 26 to front and rear straps 22, 24 is shown in FIG. 7. In this arrangement, a loop of material 60 is provided between apices 40, 48 of front and rear straps 22, 24, respectively. Loop 60 is preferably constructed of the same material as is front and rear straps 22, 24, namely a nylon mesh material capable of withstanding large loads. With the arrangement as shown in FIG. 7, the position of S-hook 58 along the length of loop 60 varies according to the user's anatomical composition, always seeking the appropriate center of gravity based on the user's position. Again, for reasons to be explained hereinafter, such variable positioning of the point of attachment of weight 26 allows proper exercising without undue stress on the user.

Figure 8:
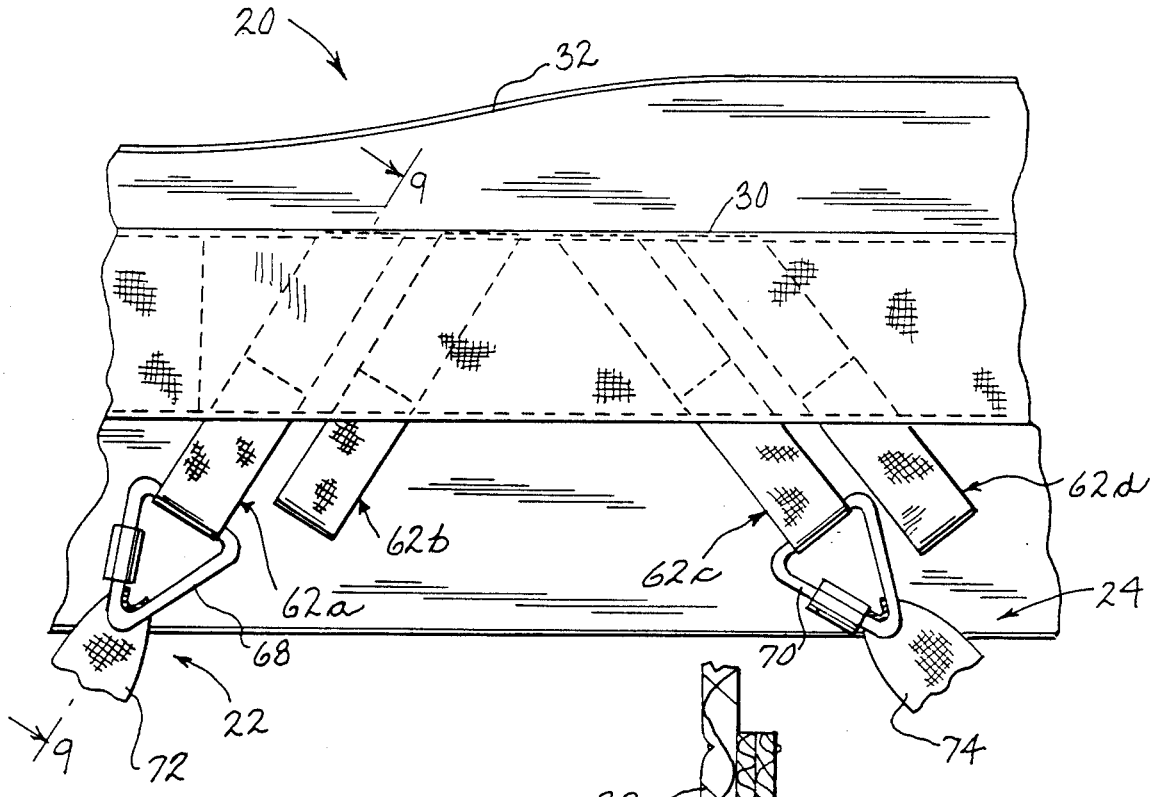
FIG. 8 is an enlarged partial side elevation view similar to FIG. 4, showing a system for adjustably varying the point of attachment of the front and rear straps to the belt.
Figure 9:
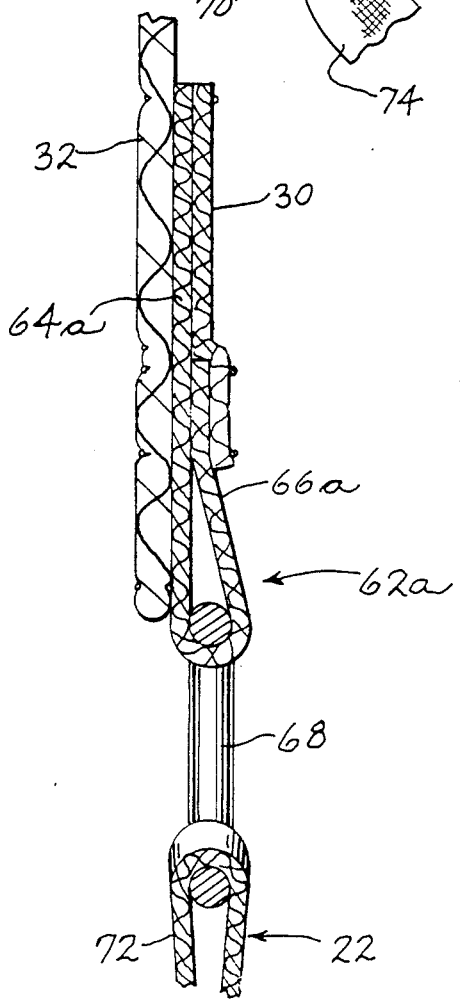
FIG. 9 is a partial sectional view taken generally along line 9—9 of FIG. 8.

FIG. 8 illustrates a variable point of attachment system for front and rear straps 22, 24. As shown, a series of loops **62*a*–62*d* are stitched into belt 20 between web 30 and padding 32. Loops 62*a*, 62*b* are disposed at an angle of approximately 45° to web 30, pointing forwardly, and loops 62*c*, 62*d* are also disposed at an angle of approximately 45° to web 30, pointing rearwardly. Accordingly, loops 62*a*, 62*b* are approximately perpendicular to loops 62*c*, 62*d*. As shown in FIG. 9, loop 62*a* is formed by an inner portion 64*a* and an outer portion 66*a*. Inner portion 64*a* is captured between the outer surface of padding 32 and the inner surface of web 30, and extends below the lower surface of web 30. Outer portion 66*a* is turned up relative to inner portion 64*a*, and is captured between padding 32 and the lower portion of web 30. The lower stitching of web 30 to padding 32 secures both inner and outer portions 64*a*, 66*a* between web 30 and padding 32, while the upper stitching of web 30 to padding 32 secures only inner portion 64*a*. If desired, an auxiliary row of stitching may be employed to secure the upper end of outer portion 66*a*. With this construction, loop 62*a* is suspended below web 30 and a majority of the length of loop 62*a* is in contact with padding 32. Loops 62*b*, 62*c* and 62*d* are constructed similarly to loop 62*a***.

A pair of triangular removable metal connecting rings 68, 70 are secured to loops **62*a*, 62*c*, respectively. As shown, ring 68 is adapted to receive an upper loop 72 provided on front strap 22, and ring 70 is adapted to receive an upper loop 74 provided on rear strap 24**.

With the arrangement as shown in FIGS. 8 and 9, it is possible to vary the point of attachment of front and rear straps 22, 24 on belt 20 by selectively positioning rings 68, 70 within loops **62*a*–62*d*. This allows the user to select the points of attachment of front and rear straps 22, 24 according to his or her physical requirements so as to provide comfortable and anatomically correct points of weight attachment. It is anticipated that, in most situations, there will be an empty loop between the loops to which rings 68, 70**, respectively, are connected, to accommodate the user's greater trochanter.

Figure 10:
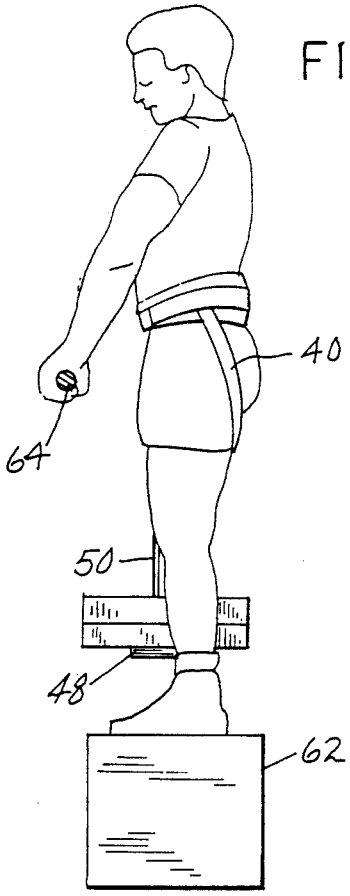
FIG. 10 is a side elevation view showing a user at the uppermost position preparing to commence a squat exercise.
Figure 11:
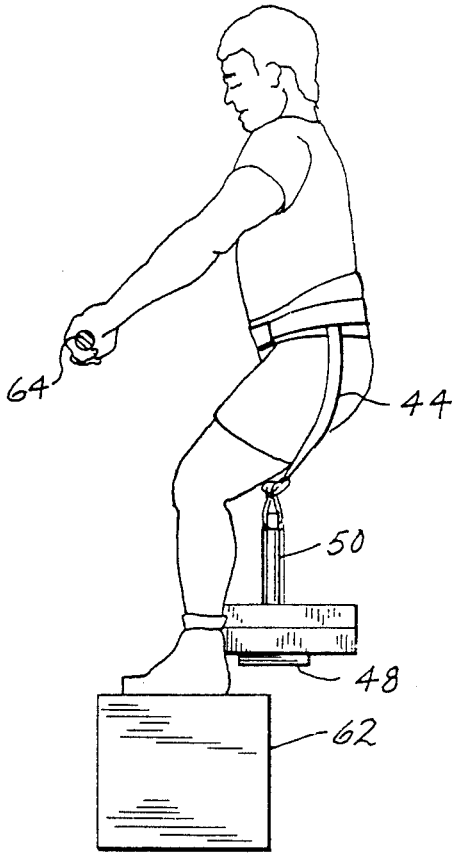
FIG. 11 is a view similar to FIG. 10, showing a user commencing a squat exercise with the apparatus of the invention.
Figure 12:
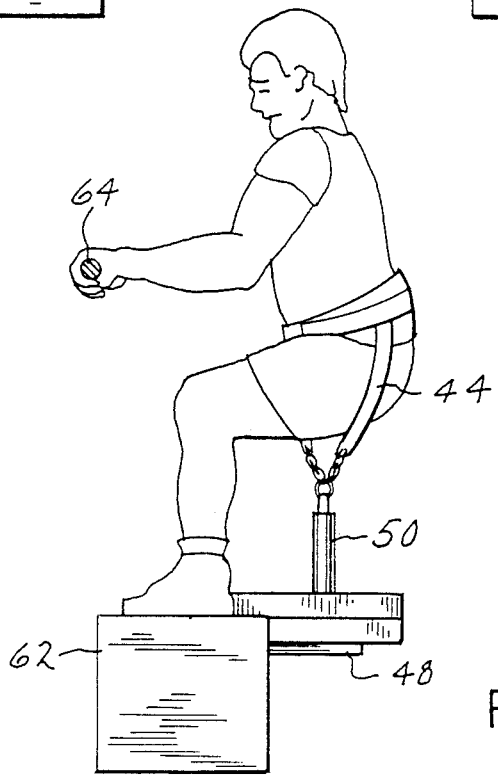
FIG. 12 is a view similar to FIGS. 10 and 11, showing a user approaching the lowermost position during performance of a squat exercise.

The apparatus as shown and described is illustrated in use in FIGS. 10–12. As shown, the user loads a predetermined amount of weight onto post 50, which is supported by base 48, thereafter attaching the weight to the connector member between the apices of front and rear straps 22, 24 in the proper position, as described. The user then stands with each foot on a pedestal, such as shown at 62, with a space being provided between the pedestals for accommodating passage of the weight thereinto. In order to accommodate imbalance, injuries or fatigue conditions, the exerciser may grasp a bar 64.

From the position of FIG. 8 the user commences squatting by bending the knees, during which the weight is lowered between the pedestals 62. As can be seen, the point of attachment of the weight to the connector member between the front and rear straps remains in a vertical line with the user's center of gravity. The user continues the squat exercise to the parallel position of FIG. 10, in which the weight continues its anterior-posterior movement during such downward movement. The point of attachment of the weight continues to remain in line with the user's center of gravity. The user then returns to the standing position of FIG. 8 to complete the repetition.

With the described arrangement, the weight is borne by the user's pelvis at a point directly superior and posterior to the greater trochanter on either side of the user, at the forward edge of the attached rear strap 24 to belt 30. The user is allowed to work the hips and legs through their full range of motion without compromising or overly stressing the joints. The load is focused laterally on the crest of the ilium, which removes the spine from any load bearing or shear force during exercise.

The angle between belt 30 and the upper ends of rear straps 22, 24 is preferably tailored to the user's anatomy, so as to provide proper bearing of the user's pelvis. It is currently contemplated that various sizes of belt 20, which is currently commercially available, will be fitted with straps 22, 24 oriented appropriately for a person who would fit into a belt of that particular size. In specialized cases, to provide a high degree of accuracy, straps 22, 24 will be custom fit for an individual user to ensure proper orientation and location of straps 22, 24. Alternatively, the system as shown in FIGS. 8 and 9 may be employed to attain a close approximation to a custom-fit of straps 22, 24.

Various alternatives and modifications are contemplated as being within the scope of the following claims particularly pointing out and distinctly claiming the subject matter regarded as the invention.

We claim:

1. A weight suspension apparatus for squat exercises, comprising:

a belt;

securing means for firmly securing said belt about the waist of a user;

front V-shaped strap means connected at its upper ends to said belt, with the nadir of said front V-shaped strap means being disposed between the user's legs;

rear V-shaped strap means connected at its upper ends to said belt closely adjacent the upper ends of said front V-shaped strap means, with the nadir of said rear V-shaped strap means being disposed between the user's legs; and weight attachment means for securing a weight to be lifted to said front and rear strap means, said weight attachment means including a weight connection member spanning between said front and rear V-shaped strap means and connected at the nadir of each; means for attaching the weight to be lifted to said weight connection member; and means for providing frontward and rearward movement of said attaching means to varying locations along said weight connection member.

2. The weight suspension apparatus of claim 1, wherein said weight connection member comprises a multi-link chain extending between said front and rear V-shaped strap means and connected at the nadir of each, said attaching means providing attachment of said weight to any one of the links in said chain between said front and rear V-shaped strap means.

3. The weight suspension apparatus of claim 1, wherein said means for providing frontward and rearward movement of said attaching means provides automatic movement of said attaching means along said weight connection member according to user requirements.

4. The weight suspension apparatus of claim 3, wherein said weight connection member comprises a flexible strap extending between the nadirs of said front and rear strap means, and wherein said attaching means comprises a connector member mounted to said flexible strap for free movement along the length of said flexible strap.

5. A weight suspension apparatus for squat exercises, comprising:

a belt;

securing means for firmly securing said belt about the waist of a user;

depending front V-shaped strap means connected to said belt such that the upper ends of said front V-shaped strap means are located substantially opposite each other when said belt is secured about the waist of said user;

depending rear V-shaped strap means connected to said belt closely adjacent the upper ends of said front V-shaped strap means such that the upper ends of said rear V-shaped strap means are located substantially opposite each other when said belt is secured about the waist of said user;

wherein an upper end of said front V-shaped strap means is located closely adjacent an upper end of said rear V-shaped strap means on each side of the user's body, with the nadirs of said front and rear V-shaped strap means being disposed between the legs of the user; and suspension means connectable to said front and rear V-shaped strap means at their nadirs for suspending at varying locations therefrom a weight to be lifted.

6. The weight suspension apparatus of claim 5, wherein said front V-shaped strap means is arranged such that each leg of said strap means forming the V-shape thereof extends from a point adjacent the user's greater trochanter downwardly along the user's inguinial ligament to a point between the user's legs on either side of the user's body when said belt is secured about the user's waist.

7. The weight suspension apparatus of claim 5, wherein said rear V-shaped strap means is arranged such that each leg of said strap means forming the V-shape thereof extends from a point posterior the user's greater trochanter downwardly about the side of the user's gluteal mass and at least partially along the user's gluteal fold to a point between the user's legs on either side of the user's body when said belt is secured about the user's waist, so that said rear V-shaped strap means and the rear of said belt act to envelope the user's gluteal mass to provide unrestricted posterior and anterior gluteal movement during use.

8. The weight suspension apparatus of claim 5, further comprising means for adjusting the point of attachment of the upper ends of said front and rear V-shaped strap means along the length of said belt.

9. The weight suspension apparatus of claim 8, wherein said attachment point adjusting means comprises a series of depending loops connected to said belt, and removable connection means for suspending said front and rear strap means from selected loops.

10. A weight suspension apparatus for squat exercises, comprising:

a belt;

securing means for firmly securing said belt about the waist of a user;

a front V-shaped strap having its nadir located between the user's legs and its upper ends connected to said belt such that each upper end is disposed closely adjacent and forwardly of the user's greater trochanter on either side of the user;

a rear V-shaped strap having its nadir located between the user's legs and its upper ends connected to said belt closely adjacent the upper ends of said front V-shaped strap means such that each upper end is disposed closely adjacent and rearwardly of the user's greater trochanter on either side of the user;

so that, on either side of the user's body, an upper end of said front strap and an upper end of said rear strap are located closely adjacent each other; and weight attachment means for securing a weight to be lifted to said front and rear straps, comprising a weight connection member spanning between said front and rear straps and connected at the nadir of each; means for attaching the weight to be lifted to said weight connection member; and means for providing frontward and rearward movement of said attaching means to varying locations along said weight connection member.

* * * * *